US009074478B2

(12) United States Patent
Ravey et al.

(10) Patent No.: US 9,074,478 B2
(45) Date of Patent: Jul. 7, 2015

(54) DAMPED ASSEMBLY

(75) Inventors: Eric P. Ravey, Diseworth (GB); Matthew D. Curren, Derby (GB)

(73) Assignee: ROLLS-ROYCE plc, London (GB)

( * ) Notice: Subject to any disclaimer, the term of this patent is extended or adjusted under 35 U.S.C. 154(b) by 804 days.

(21) Appl. No.: 13/207,835

(22) Filed: Aug. 11, 2011

(65) Prior Publication Data

US 2012/0070270 A1 Mar. 22, 2012

(30) Foreign Application Priority Data

Sep. 22, 2010 (GB) ..... 1015862.4

(51) Int. Cl.

| | |
|---|---|
| ***F01D 25/06*** | (2006.01) |
| ***F01D 9/04*** | (2006.01) |
| ***F01D 5/16*** | (2006.01) |
| ***F04D 29/54*** | (2006.01) |
| ***F04D 29/66*** | (2006.01) |
| ***F01D 5/10*** | (2006.01) |
| ***F01D 5/22*** | (2006.01) |
| ***F01D 5/26*** | (2006.01) |
| ***F01D 21/00*** | (2006.01) |
| ***F01D 25/04*** | (2006.01) |

(52) U.S. Cl.

CPC *F01D 9/042* (2013.01); *F01D 5/16* (2013.01); *F04D 29/542* (2013.01); *F04D 29/668* (2013.01); *F05D 2260/96* (2013.01); *F01D 5/10* (2013.01); *F01D 5/22* (2013.01); *F01D 5/26* (2013.01); *F01D 21/003* (2013.01); *F01D 25/04* (2013.01)

(58) Field of Classification Search

CPC ..... F01D 21/003; F01D 25/04; F01D 5/10; F01D 5/16; F01D 5/22; F01D 5/26

USPC ..... 415/191, 209.3, 210.1, 211.2; 416/215–218, 220 R, 248

See application file for complete search history.

(56) References Cited

U.S. PATENT DOCUMENTS

| | | | | |
|---|---|---|---|---|
| 2,914,300 | A * | 11/1959 | Sayre | 415/135 |
| 3,836,282 | A | 9/1974 | Mandelbaum et al. | |
| 5,074,752 | A * | 12/1991 | Murphy et al. | 415/209.4 |
| 7,665,963 | B2 * | 2/2010 | Bogue et al. | 415/191 |
| 8,210,819 | B2 * | 7/2012 | Wiebe et al. | 416/218 |
| 2004/0062652 | A1 * | 4/2004 | Grant et al. | 416/220 R |

FOREIGN PATENT DOCUMENTS

| | | | | |
|---|---|---|---|---|
| EP | 0 811 753 | A1 | 12/1997 | |
| EP | 1 911 931 | A2 | 4/2008 | |
| GB | 2 110 768 | A | 6/1983 | |
| GB | 2110768 | A * | 6/1983 | F01D 9/02 |
| GB | 2 418 709 | A | 4/2006 | |

OTHER PUBLICATIONS

Search Report issued in European Patent Application No. 11 17 7240 dated Nov. 25, 2013.

British Search Report issued in Application No. GB1015862.4 dated Jan. 11, 2011.

* cited by examiner

*Primary Examiner* — Nathaniel Wiehe
*Assistant Examiner* — Woody A Lee, Jr.
(74) *Attorney, Agent, or Firm* — Oliff PLC

(57) ABSTRACT

A damped assembly within a gas turbine, comprising a first member and a second member mechanically connected via an intermediate vibration dampener which has at least first and second surfaces for contacting the first and second members respectively, wherein either or both of the first and second surfaces include a plurality of raised portions in direct contact with the respective member and a plurality of recessed portions which contain adhesive for bonding the intermediate vibration dampener to the respective member.

14 Claims, 1 Drawing Sheet

DAMPED ASSEMBLY

This invention relates to a damped assembly in a gas turbine. In particular, this invention relates to a damped assembly having an intermediate vibration dampener which can be tuned to adjust the natural frequency of the assembly or one or more of its constituent members.

It is well known that mechanical parts within gas turbines, such as fan outlet guide vanes or compressor nozzle guide vanes, experience varying degrees of mechanical vibration. One known method of helping to reduce the amplitude of these vibrations is the use mechanical damping.

GB2418709 provides an example of a known mechanical damping element. In the described assembly, collars of compliant material are used to couple vanes of a nozzle guide assembly to a support structure within an aero-engine. The ends of the vanes are held between an inner ring and an outer supporting structure via the collars which are adhered in place. The collars provide a cushioning effect to absorb and reduce the amplitude of the vibrations experienced by the vanes.

As noted in GB2418709 the use of such inserts can result in a reduced natural frequency in the assembly components which can be close to the engine order forcing frequencies. This can result in increased vibration amplitudes and tuning of a damper is required to help avoid this. In GB2418709 the collars include metal plates, either on a surface or within the structure, which acts to stiffen the collar, thereby helping to prevent a lowering of the natural frequency of the vane. However, inclusion of the metal strip unnecessarily complicates the construction of the collar and adds cost and weight to the component.

The present invention seeks to overcome some of the problems of the prior art.

In a first aspect, the present invention provides a damped assembly for a gas turbine engine, comprising: a first member and a second member mechanically connected via an intermediate vibration dampener which has at least first and second surfaces for contacting the first and second members respectively, wherein either or both of the first and second surfaces include a plurality of raised portions in direct contact with the respective member and a plurality of recessed portions which contain adhesive for bonding the intermediate vibration dampener to the respective member.

Typically, the adhesive is a compliant material which lowers the natural frequency of the intermediate vibration dampener. Having a combination of directly contacting surfaces and adhesively bonded surfaces allows the rigidity of the intermediate vibration dampener to be retained which prevents the natural frequency of the assembly dropping beyond a predetermined amount.

The ratio of raised portion to recessed portion for each of the first and second surfaces is predetermined so as to result in a desired frequency response for the first and second members.

A further advantage of the present invention is that the ratio of raised portions and recessed portions can be adjusted, thereby providing a tuning mechanism with which the natural frequency of the assembly can be increased or lowered. In this way, the natural frequency of the assembly can be tailored around the engine order forcing frequencies as required.

The first and second members may be parts of a fan stage or a compressor stage in a gas turbine engine. The first member may be a supporting structure. The supporting structure may be an outer ring. The first member may be an inner ring.

The second member may be an elongate member. The elongate member may be a bar or a vane. The bar or vane may be within an outlet guide vane assembly or a nozzle guide vane assembly.

In the case of an elongate member, the intermediate vibration dampener may be a sleeve. The first and second surfaces of the intermediate vibration dampener may be the inner and outer circumferential faces of the sleeve. The assembly may include further members which may be mechanically coupled via further intermediate vibration dampeners.

The recessed portions may be concave. The recessed portions may be apertures. The recessed portions may be round, for example, circular or oval. The recessed portions may be polygonal, for example, square or rectangular. The apertures may pass through from the first surface to the second surface of the intermediate vibration dampener such that the recessed portions on each surface are respective ends of the same aperture.

The raised portions may be convex dimples. The raised portions might be protrusions or projections. The raised portions may be polygonal. The raised portions may be round.

The raised portions and recessed portions may alternate in a first direction on either or both of the first and second mating surfaces so as to provide a grooved surface. The ridges and troughs of the grooves may run perpendicular to the first direction.

The grooved surface may have a wave-like cross-section. Preferably, the grooved surface forms a castellation like structure in the cross-section such that the raised portions and recessed portions are substantially flat.

The recessed portions may have substantially similar dimensions to each other. The raised portions may have substantially similar dimensions to each other. The raised portions and recessed portions on either or both of the first and second surfaces may be uniformly distributed. Alternatively, the distribution may be non-uniform. Having a non-uniform distribution of raised and recessed portions allows the intermediate vibration dampener to be tuned to account for anisotropic variations in the frequency response of the first and second members.

In the case where the intermediate vibration dampener is a sleeve located within a corresponding socket, the outside dimensions of the sleeve may be greater than the socket so as to provide a snug interference fit. This allows the raised portions to be wiped clean of any adhesive via a "squeegee effect" during assembly, thereby ensuring the raised portions are in direct contact with the opposing surface.

The intermediate vibration dampener may include one or more formations to help locate the first and second members in a desired position during assembly. The formation may be positioned so as to prevent adhesive being removed from the recessed portions during assembly of the assembly. The formation may be a flange. The flange may extend circumferentially around the intermediate vibration member on either or both the first or second surface.

The intermediate vibration dampener may be bonded with adhesive to the first member only. Alternatively, the intermediate vibration dampener may be bonded to the second member only. Where a member is elongate, it may be free to axially slide within the intermediate vibration dampener. Having the intermediate dampener bonded to only one of the members allows relative movement to the other which can be beneficial in the case of differential thermal expansion.

Either or both of substantially the entire first and second surfaces may be in direct contact with the respective member. Having the entirety of a surface in contact with its respective member means the surface does not have recessed portions for adhesive contact. This can be beneficial for tuning purposes where a surface is not required to be bonded.

The intermediate vibration dampener may be an elastomeric material. The intermediate vibration dampener may be a hyperelastic material which displays a typically non-linear elastic isotropic stress-strain relationship. For example, the hyperelastic material may be a synthetic rubber made from the polymerization of a variety of monomers. The material may be taken from one of the group which includes silicone based rubber, Polyurethane and Fluoro Silicone. The skilled person will appreciate from the description of the invention, that other suitable materials dampening materials may be employed.

The intermediate vibration dampener may be loaded with an embedded medium to provide increased rigidity to the material. Loading can alter the natural frequency of the intermediate vibration dampener and associated assembly, thereby providing a further tuning aid.

The medium may comprise fibres. The fibres may be aramid known under the commercial name Kevlar. The medium may be particles. The particles may be beads or spheres. The spheres may be glass nano-spheres. The medium may include carbon nano-tubes. The intermediate vibration dampener may include the medium in specific layers. The medium may include continuous and or chopped carbon fibres, glass fibres, aramid and or boron fibres.

The skilled addressee will appreciate that the members which form the assembly can be a variety of materials, as determined by the role of the assembly and individual members. Typical materials may include metals or metallic alloys, such as Aluminium, Steel of Titanium, or plastics or composite materials. The composite materials may include Organic Matrix Composites (OMC), Metallic Matrix Composites (MMC) and Ceramic Matrix Composites (CMC). However, the invention is particularly suited to Organic Matrix Composites. The matrix may be thermoplastic, thermoset, or polyester based. This invention include therefore hybrid Organic Matrix Composites. Coating materials can be added on the surface of the damped assembly members to meet specific requirement(s) i.e. erosion protection.

The adhesive for bonding the intermediate vibration dampener to the respective components may be one from the group including epoxy resins and styrene block co-polymers.

In a second aspect, the present invention provides a method of assembling a damped assembly, the damped assembly comprising: a first member and a second member mechanically connected via an intermediate vibration dampener which has at least first and second surfaces for contacting the first and second members respectively, wherein either or both of the first and second surfaces include a plurality of raised portions in direct contact with the respective member and a plurality of recessed portions which contain adhesive for bonding the intermediate vibration dampener to the respective member, wherein either the first or second member is an elongate member and the intermediate vibration dampener is a sleeve positioned over an end of the elongate member and wherein the sleeve is located within a corresponding socket in the other of the first or second member and the outside dimensions of the sleeve are greater than the corresponding socket dimensions such that the raised portions achieve a snug interference fit and adhesive is wiped from the raised portions during assembly, the method of assembly including the steps of: applying adhesive to predetermined recessed portions; slidably inserting the second member, intermediate vibration dampener and first member under pressure so as to remove adhesive from the raised portions.

An embodiment of the invention will now be described with the aid of the following Figures in which.

Figure 1:
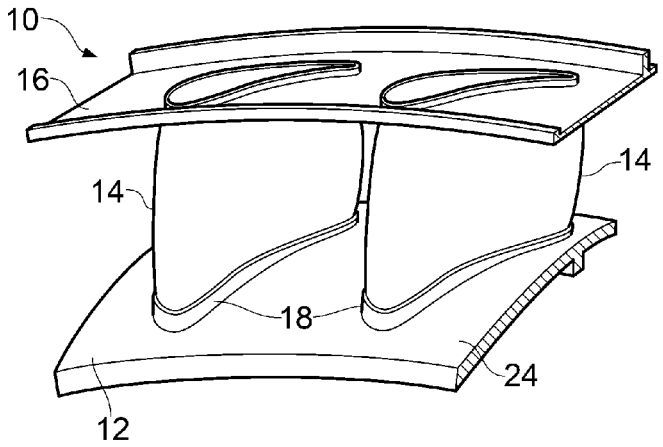
FIG. 1 shows nozzle guide vane assembly structure for a gas turbine engine in which the vanes are located using an intermediate vibration dampener.

FIG. 1 shows a damped assembly in the form of a section of an annular nozzle guide vane assembly 10 for a gas turbine engine. The nozzle guide vane assembly 10 includes a first member in the form an inner ring 12 and a plurality of second members in the form of vanes 14. The vanes 14 are connected at a first end to the inner ring 12 via intermediate vibration dampeners in the form of elastomeric sleeves 18. The vanes 14 are connected at a second end to an outer supporting section 16 and held in a stationary position so as to direct the air flow onto a subsequent rotating blades or blink at a preferred angle.

Figure 2:
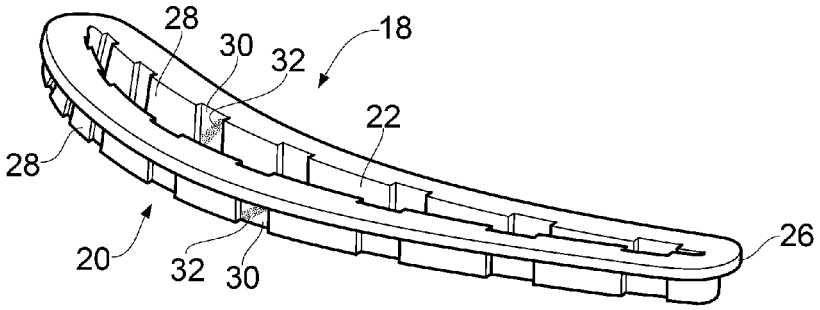
FIG. 2 shows an embodiment of the intermediate vibration dampener shown in FIG. 1.
Figure 3:
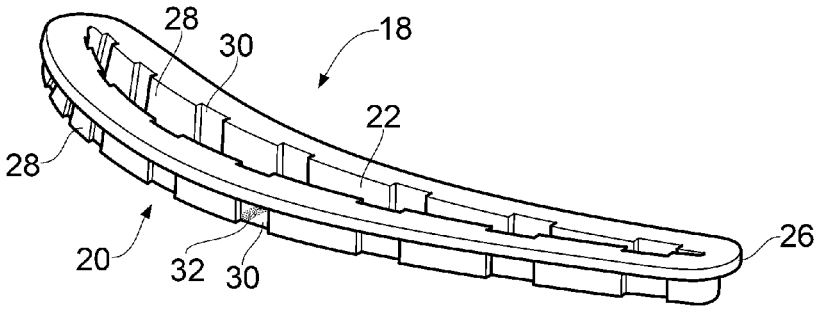
FIG. 3 shows another embodiment of the intermediate vibration dampener shown in FIG. 1.

FIGS 2 and 3 show the elastomeric sleeve 18 according to the present invention. The sleeve 18 has a first surface in the form of an outer contacting surface 20, and a second surface in the form of an inner contacting surface 22. The outer contacting surface 20 of the sleeve 18 is snugly received within a corresponding aperture in the inward facing surface 24 of the inner ring 12. The inner contacting surface 22 is shaped and sized to snugly receive an end of the vane 14 in a plug and socket relationship.

The distal end of the sleeve 18 includes a formation in the form of a flange 26 which extends radially outwards from the outer contacting surface 20. When assembled, the proximal face of the flange 26 abuts the opposing inward facing surface 24 of the inner ring 12 so as to prevent the sleeve 18 passing through the aperture.

The purpose of the intermediate vibration dampener 18 is to reduce the amplitude of the vibrations in the vane 14. Typically, an intermediate vibration dampener 18, such as the one described above for GB2418709, is bonded to either or both the vane 14 and inner ring 12 with an adhesive. The adhesive acts to prevent separation of the components during use. However, the adhesives typically used are compliant materials which lower the natural frequency of the vanes 14 which can result in the natural frequency of the vane 14 becoming close to or within an engine order forcing frequency. This can lead to an increase in the vibration experienced by the vane 14, thereby defeating the object of the intermediate vibration dampener.

Prior attempts to prevent the lowering of the natural frequency have focussed on increasing the rigidity of the intermediate vibration dampeners 18, as discussed above. However, known measures invariably add weight to an assembly and require a more complicated manufacturing process, both of which are undesirable.

The described embodiment provides each of the inner 22 and outer 20 surfaces with raised portions 28 and recessed portions 30. The raised portions 28 and recessed portions 30 are formed from rectangular grooves which run from the distal end of the first and second surfaces to the proximal end thereof. The grooves provide a castellation of sequentially alternating raised portions 28 and recessed portions 30.

When assembled the raised portions 28 are placed in intimate and direct contact with the respective surface of the vane 14 or inner ring 12. The recessed portions 30 are of suitable dimensions so as to receive a predetermined amount of adhesive 32 which is sufficient to bond the respective surface of the inner ring or vane without excessive spillage onto adjacent raised portions 28.

In this way, when the assembly is put together the raised portions 28 of the first and second surfaces are in intimate contact with the respective mating surface which acts to maintain the natural frequency of the sleeve 18 without being affected by the compliance of the adhesive. The recessed portions 30 allow the sleeve 18 to be glued in place without coming loose during operation.

To aid the assembly and direct contact of the raised portions 28 with the mating surface of the inner ring, the outside dimensions of the sleeve 18 are slightly larger than the corresponding dimensions of the aperture in the inner ring 12. This provides a snug interference fit upon assembly. The interference fit allows the leading edge of the inner ring aperture to wipe any adhesive off the raised portion 28 in a squeegee like way. Hence, the raised portions 28 are free to make a good direct contact with the opposing surface.

To help prevent the adhesive being pushed out of the recessed portions during assembly and the associated squeegee effect, the flange acts to close the end of the recessed portions.

The inner contacting surface 22 of the sleeve 18 also includes a castellated profile. This mates with the outer surface of the vane 14. In embodiment such as the one shown in FIG. 3, the inner contacting surface 22 does not include adhesive such that the vane is free to axially slide within the sleeve 18. Having a sliding configuration such as this allows for differential thermal expansion in the vane 14 and inner ring 12 so as to help reduce stress in the assembly 10.

Typically, a gas turbine will have several engine order forcing frequencies, each corresponding to a major component in the engine (e.g. a particular fan or blisk). Hence, it is highly advantageous to be able to provide a component which can be tuned during the design and manufacture such that a particular natural frequency can be achieved. With the present invention, the ratio of the raised portions 28 and recessed portions 30 can be adjusted to increase or lower the amount of direct contact with the respective opposing surface of either the inner ring 12 or vane 14.

Further, the recessed and raised portions can be non-uniform around the circumference of the first and second surfaces such that anisotropic vibrations in the vane can be accounted for and a greater degree of dampening or adhesive applied as required for a particular structure. For example, having non-uniform recessed and raised portions in this way allows the differential tuning of mode shapes i.e. bow and torsion modes.

The inner ring 12, outer casing 16 and vanes 14 are made from Titanium. The intermediate vibration dampener 18 is made from rubber. However, the skilled person will appreciate that other materials can be used whilst retaining the advantages of the present invention.

Although the description of the invention is limited to the above embodiment, the skilled addressee will appreciate that the inventive concept goes beyond the limits of the embodiment. For example, the assembly can be any construction of parts within a gas turbine where vibration control is necessary and an intermediate vibration dampener can be employed.

The skilled person will also appreciate that the requirements of the assembly and intermediate vibration dampener in terms of frequency response will vary depending on particulars of the gas turbine in which they are employed.

The invention claimed is:

1. A damped assembly for a gas turbine engine, comprising:

a first member and a second member mechanically connected via an intermediate vibration dampener which has at least first and second surfaces for contacting the first and second members respectively, wherein either or both of the first and second surfaces include a plurality of raised portions in direct contact with the respective member and a plurality of recessed portions which contain adhesive for bonding the intermediate vibration dampener to the respective member, wherein the ratio of the raised portion surface area to the recessed portion surface area for each of the first and second surfaces is predetermined so as to provide a required dampening for a predetermined frequency range, wherein a distribution of the raised portions and recessed portions on either or both of the first and second surfaces is non-uniform, wherein the second member is an elongate member and the intermediate vibration dampener is a sleeve positioned over an end of the elongate member, and wherein a dimension, with respect to a longitudinal axis of the second member, of at least one of the recessed and/or raised portions is extended as compared to at least one other of the recessed and/or raised portions, along the longitudinal axis of the second member.

2. A damped assembly as claimed in claim 1 wherein the recessed portions are elongate grooves in the respective surface.

3. A damped assembly as claimed in claim 1 wherein the intermediate vibration dampener is bonded with adhesive to one of the first and second members only.

4. A damped assembly as claimed in claim 1 wherein substantially the entire second surface is in direct contact with the respective member.

5. A damped assembly as claimed in claim 1 wherein the intermediate vibration dampener is an elastomeric material.

6. A damped assembly as claimed in claim 1 wherein either or both of the members are made from a composite material.

7. A damped assembly as claimed in claim 1 wherein the elongate member is arranged to axially slide within the intermediate vibration dampener.

8. A damped assembly as claimed in claim 1 wherein the sleeve is located within a corresponding socket in the other of the first or second member and the outside dimensions of the sleeve are greater than the corresponding socket dimensions such that the raised portions achieve a snug interference fit and adhesive is wiped from the raised portions during assembly.

9. A damped assembly as claimed in claim 8 wherein the recessed portions include a formation which prevents adhesive being removed from the recessed portions during assembly.

10. A damped assembly as claimed in claim 1 wherein the second member is a vane.

11. A damped assembly as claimed in claim 1 wherein the intermediate vibration dampener includes embedded material which increases the stiffness of the intermediate vibration dampener.

12. A damped assembly as claimed in claim 1 wherein the adhesive is retained and has a function in the dampening.

13. A damped assembly as claimed in claim 1 wherein the sleeve is an open-ended sleeve.

14. A damped assembly for a gas turbine engine, comprising:

a first member and a second member mechanically connected via an intermediate vibration dampener which has at least first and second surfaces for contacting the first and second members respectively, wherein either or both of the first and second surfaces include a plurality of raised portions in direct contact with the respective member and a plurality of recessed portions which contain adhesive for bonding the intermediate vibration dampener to the respective member, wherein the ratio of the raised portion surface area to the recessed portion surface area for each of the first and second surfaces is predetermined so as to provide a required dampening for a predetermined frequency range, wherein a distribution of the raised portions and recessed portions on either or both of the first and second surfaces is non-uniform, wherein the second member is an elongate member and the intermediate vibration dampener is a sleeve positioned over an end of the elongate member, and wherein an axial extent of at least one of the recessed and/or raised portions relatively closer to a leading edge of the intermediate vibration dampener is different from an axial extent of at least one of the recessed and/or raised portions relatively farther from the leading edge of the intermediate vibration dampener.

* * * * *